US006310618B1

(12) United States Patent
Zhang et al.

(10) Patent No.: US 6,310,618 B1
(45) Date of Patent: Oct. 30, 2001

(54) CLOCK GENERATION FOR SAMPLING ANALONG VIDEO

(75) Inventors: Biao Zhang, Sunnyvale; Chin-Cheng Kau, Fremont, both of CA (US)

(73) Assignee: SmartASIC, Inc., San Jose, CA (US)

( * ) Notice: Subject to any disclaimer, the term of this patent is extended or adjusted under 35 U.S.C. 154(b) by 0 days.

(21) Appl. No.: 09/190,966

(22) Filed: Nov. 13, 1998

(51) Int. Cl.[7] ..... G09G 5/00

(52) U.S. Cl. ..... 345/213; 345/3; 345/99; 345/204; 348/536; 348/537

(58) Field of Search ..... 345/3, 11, 99, 345/132, 204, 213, 520; 348/513, 536, 537

(56) References Cited

U.S. PATENT DOCUMENTS 5,499,036 * 3/1996 Hauck ..... 345/3
5,686,933 * 11/1997 Okada et al. ..... 345/95
5,706,035 * 1/1998 Tsunoda et al. ..... 345/213
5,796,392 8/1998 Eglit .
5,841,430 * 11/1998 Kurikko ..... 345/213
5,926,174 * 7/1999 Shibamiya et al. ..... 345/213
6,037,921 * 3/2000 Matsumoto et al. ..... 345/88
6,046,737 * 4/2000 Nakamura ..... 345/213

* cited by examiner

*Primary Examiner*—Bipin Shalwala
*Assistant Examiner*—Vincent E. Kovalick
(74) *Attorney, Agent, or Firm*—Bever, Hoffman & Harms, LLP; Edward S. Mao

(57) ABSTRACT

A method and circuit generates a sampling clock signal that digitizes an analog video signal. The sampling clock signal is generated by a clock divider coupled to the horizontal synchronization signal of the analog video signal. A divisor calculator calculates a divisor for the clock divider to control the frequency of the sampling clock signal. Specifically, the divisor calculator selects an initial divisor for the clock divider. Then the divisor calculator calculates a new divisor based on the target pixel value provided by a mode detector and the measured pixel value from a counter. Some embodiments of the present invention fine tune the frequency by testing other possible divisors with a plurality of different phases. In addition, some embodiments of the present invention calibrate the phase of the sampling clock signal to generate a phase shifted sampling clock signal.

16 Claims, 9 Drawing Sheets

CLOCK GENERATION FOR SAMPLING ANALONG VIDEO

BACKGROUND OF THE INVENTION

1. Field of the Invention

The present invention relates to digital graphics systems. More specifically, the present invention relates to methods and circuits for sampling analog video signals for digital display systems.

2. Discussion of Related Art

Analog video displays such as cathode ray tubes (CRTs) dominate the video display market. Thus, most electronic devices that require video displays, such as computers and digital video disk players, output analog video signals. As is well known in the art, an analog video display sequentially reproduces a large number of still images to give the illusion of full motion video. Each still image is known as a frame. For television, 60 frames are displayed in one second. For computer applications, the number of frames per seconds is variable with typical values ranging from 56 to 100 frames per seconds.

FIG. 1(*a*) illustrates a typical analog video display 100. Analog video display 100 comprises a raster scan unit 110 and a screen 120. Raster scan unit 110 generates an electron beam 111 in accordance with an analog video signal VS, and directs electron beam 111 against screen 120 in the form of sequentially-produced horizontal scanlines 101–109, which collectively form one frame. Screen 120 is provided with a phosphorescent material that is illuminated in accordance with the video signal VS transmitted in electron beam 111 to produce contrasting bright and dark regions that create an image, such as the diamond shape shown in FIG. 1(*a*). After drawing each scanline 101–108, raster scan unit 110 performs a horizontal flyback 130 to the left side of screen 120 before beginning a subsequent scanline. Similarly, after drawing the last scanline 109 of each frame, raster scan unit 110 performs a vertical flyback 131 to the top left corner of screen 120 before beginning a subsequent frame. To avoid generating an unwanted flyback traces (lines) on screen 120 during horizontal flyback 130, video signal 130 includes a horizontal blanking pulse that turn off electron beam 111 during horizontal flyback 130. Similarly, during vertical flyback 135, video signal VS includes a vertical blanking pulse that turns off electron beam 111 during vertical flyback 135.

FIG. 1(*b*) illustrates a typical analog video signal VS for analog video display 100. Video signal VS is accompanied by a horizontal synchronization signal HSYNCH and a vertical synchronization signal VSYNCH (not shown). Vertical synchronization signal VSYNCH contains vertical synch marks to indicate the beginning of each new frame. Typically, vertical synchronization signal VSYNCH is logic high and each vertical synch mark is a logic low pulse. Horizontal synchronization signal HSYNCH contains horizontal synch marks (logic low pulses) 133, 134, and 135 to indicate the beginning of data for a new scanline. Specifically, horizontal synch mark 133 indicates video signal VS contains data for scanline 103; horizontal synch mark 134 indicates video signal VS now contains data for scanline 104; and horizontal synch mark 135 indicates video signal VS now contains data for scanline 105.

Video signal VS comprises data portions 112, 113, 114, and 115 that correspond to scanlines 102, 103, 104, and 105, respectively. Video signal VS also comprises horizontal blanking pulses 123, 124 and 125, each of which is located between two data portions. As explained above, horizontal blanking pulses 123, 124, and 125 prevent the electron beam from drawing unwanted flyback traces on analog video display 100. Each horizontal blanking pulse comprises a front porch FP, which precedes a horizontal synch mark, and a back porch BP which follows the horizontal synch mark. Thus, the actual video data for each row in video signal VS lies between the back porch of a first horizontal blanking pulse and the front porch of the next horizontal blanking pulse.

Digital video display units, such as liquid crystal displays (LCDs), are becoming competitive with analog video displays. Typically, digital video display units are much thinner and lighter than comparable analog video displays. Thus, for many video display functions, digital video displays are preferable to analog video displays. For example, a 19 inch (measured diagonally) analog video display, which has a 17 inch viewable area, may have a thickness of 19 inches and weigh 80 pounds. However, a 17 inch digital video display, which is equivalent to a 19 inch analog video display, may be only 4 inches thick and weigh less than 15 lbs. However, most computer systems are designed for use with analog video displays. Most computer systems output analog video signals, such as video signal VS and horizontal synchronization signal HSYNCH. Thus, the analog video signal provided by a computer must be converted into a format compatible with digital display systems.

FIG. 1(*c*) illustrates a typical digital display 150. Digital display 150 comprises a grid of picture elements ("pixels") divided into rows 151–159 and columns 161–174. Each data portion (e.g. data portions 112, 113, 114, and 115) is treated as one row of a digital display. Each data portion is also divided into smaller portions and digitized to form pixel data that is transmitted to its designated pixel using row driver 180 and column driver 190. For most computer applications, the number of columns can be determined by the vertical resolution, which is equal to the number of rows. For example, common computer display formats include 640 columns by 480 rows (640×480), 800 columns by 600 rows (800×600), 1024 columns by 768 rows (1024×768), and 1280 columns by 1024 rows (1280×768). If video signal VS (FIG. 1(*b*)) contains 480 rows, then data portion 114 is divided into 640 smaller portions, which are individually digitized to form 640 pixel data for pixels of one row. Typically, the digitized image is stored in a frame buffer, which is used to drive row driver 180 and column driver 190. The actual physical digital display unit may contain thousands of pixels, thus the digital image stored in the frame buffer must be scaled accordingly before being displayed on the digital display.

To create a digital display from an analog video signal, the analog video signal must be digitized at precise locations to form the pixels of a digital display. Typically, a sampling clock signal is used to digitize video signal VS. However, the sampling clock signal must have a frequency and phase such that the sampling clock has the same number of periods during a data portion of video signal VS as the number of pixels to be sampled in that data portion. Creation of the sampling clock signal is complicated because the size of the front porch and back porch of a video signal may differ from computer to computer. Furthermore, different display resolutions on the same computer may also use differently sized front porches and back porches. Hence, there is a need for a method or circuit to generate a sampling clock signal that can be used to convert analog video signals into digital display data.

SUMMARY

The present invention generates a precisely tuned sampling clock signal, which can be used to convert analog video signals into pixels for digital displays. In accordance with one embodiment of the present invention, a mode detector determines a target pixel value that is equal to the desired number of pixels in a data portion of the video signal. A clock divider receives the horizontal synchronization signal of the video signal and generates a sampling clock signal using an initial divisor supplied by a divisor calculator. A counter measures a measured pixel value, which is equal to the number of pixels that would be sampled using the current sampling clock signal. The divisor calculator calculates a first divisor so that the measured pixel value will equal the target pixel value and transmits the first divisor to the clock divider. The clock divider then regenerates the sampling clock signal using the first divisor.

In some embodiments of the divisor calculator, the initial divisor is generated by a initial divisor lookup table based on the vertical resolution of the video signal. In other embodiments, the initial divisor is preset to a specific number. For example, in a specific embodiment, the initial divisor is always set equal to 1024. The first divisor is calculated by a multiplier/divider by multiplying the target pixel value with the initial divisor to form a product, and then dividing the product by the measured pixel value. A multiplexer selects whether the initial divisor or the first divisor is transmitted to the clock divider. Some embodiments of the divisor calculator also includes an adder/subtractor which calculates a second divisor by recursively adding the target pixel value and subtracting the measured pixel value until the target pixel value equals the measured pixel value. Furthermore, some embodiments of the divisor calculator includes a fine tuning circuit which generates a third divisor by analyzing various phases of the sampling clock signal and various values for the divisor transmitted to the clock divider.

Some embodiments of the present invention includes a phase shifter configured to generate a phase shifted sampling clock signal by phase shifting the sampling clock signal to achieve a high image quality index. In one embodiment, the period of the sampling clock signal is divided into a plurality of ranges. An image quality index is measured for each range. A best range with the highest quality index is determined. The best range is subdivided into a second plurality of ranges. The process of selecting best ranges and subdividing the best range into additional ranges is repeated until the size of a best range is less than a range threshold. The phase of the sampling clock signal divisor is phase shifted by an amount equal to the midpoint of the best range.

The present invention will be more fully understood in view of the following description and drawings.

BRIEF DESCRIPTION OF THE DRAWINGS

FIG. 1(*b*) is an analog video signal and a horizontal synchronization signal.

FIG. 1(*c*) is a simplified illustration of a digital video display.

FIG. 2(*b*) is a flow chart for a clock generation circuit in accordance with one embodiment of the present invention.

DETAILED DESCRIPTION

Figure 1A:
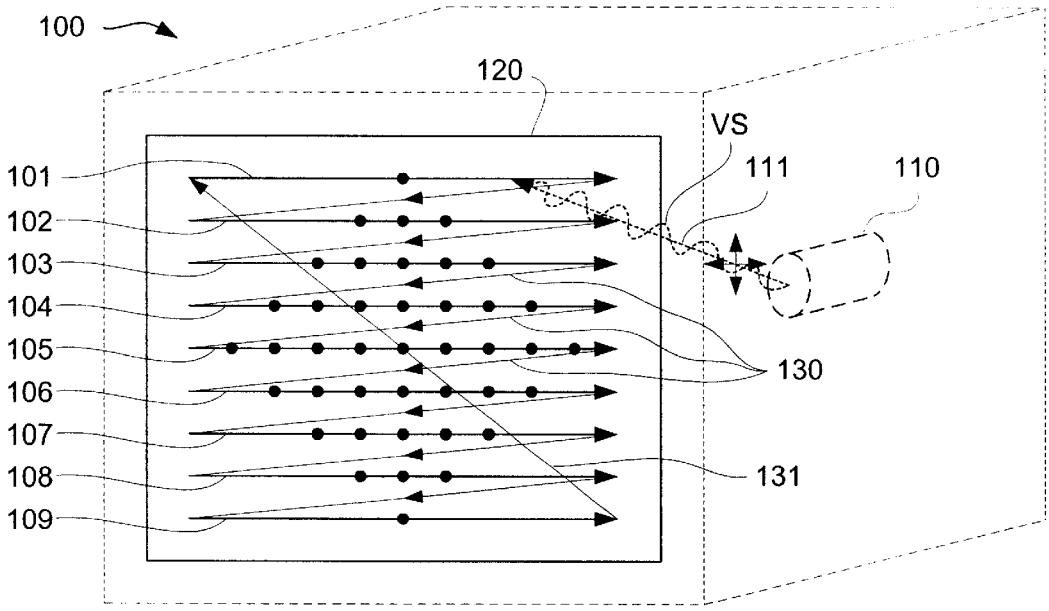
FIG. 1(*a*) is a simplified illustration of an analog video display.
Figure 1B:
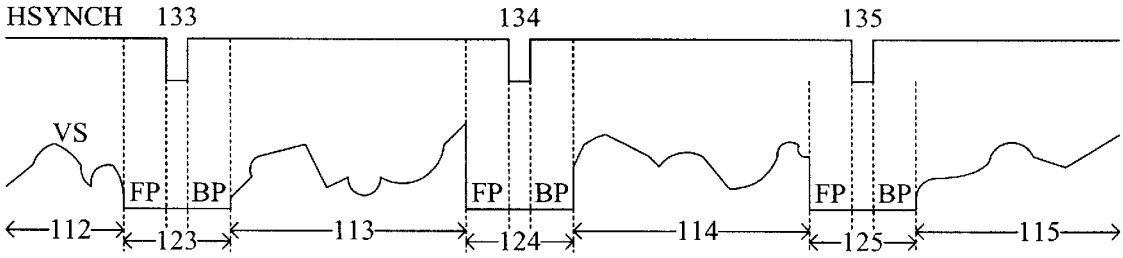
Figure 1C:
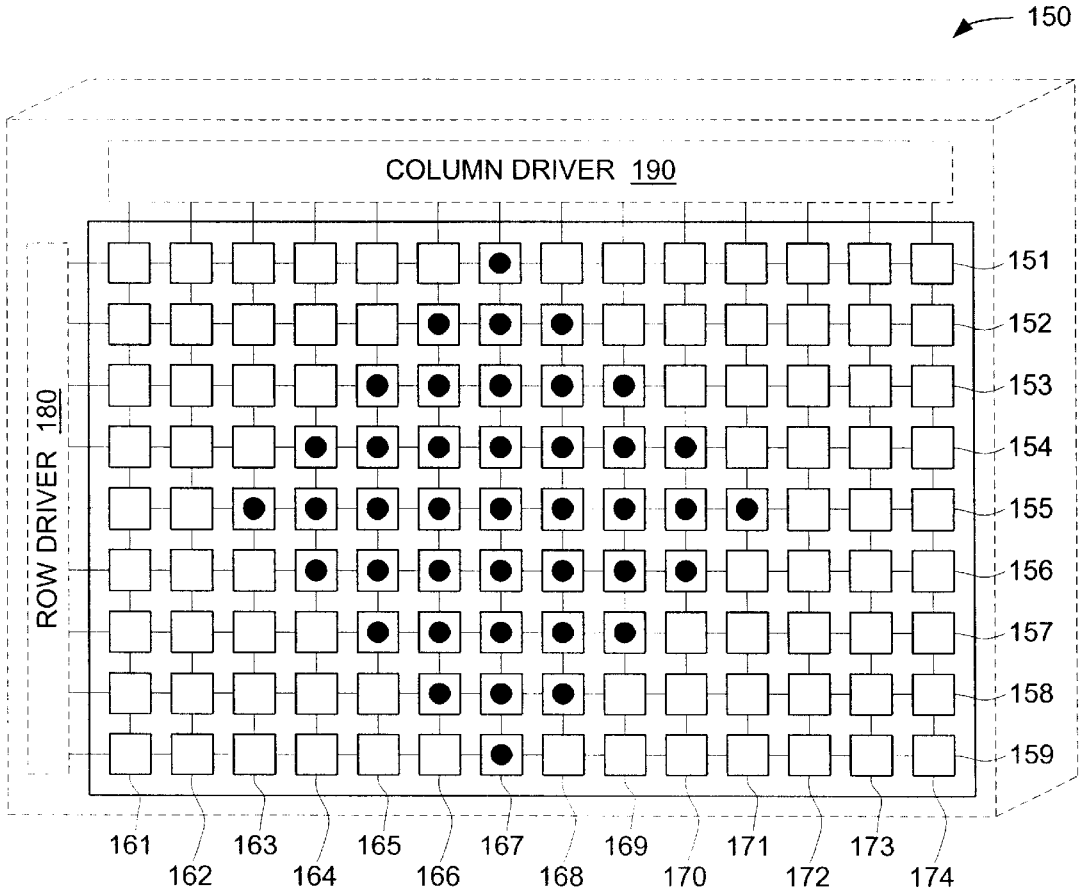
Figure 2A:
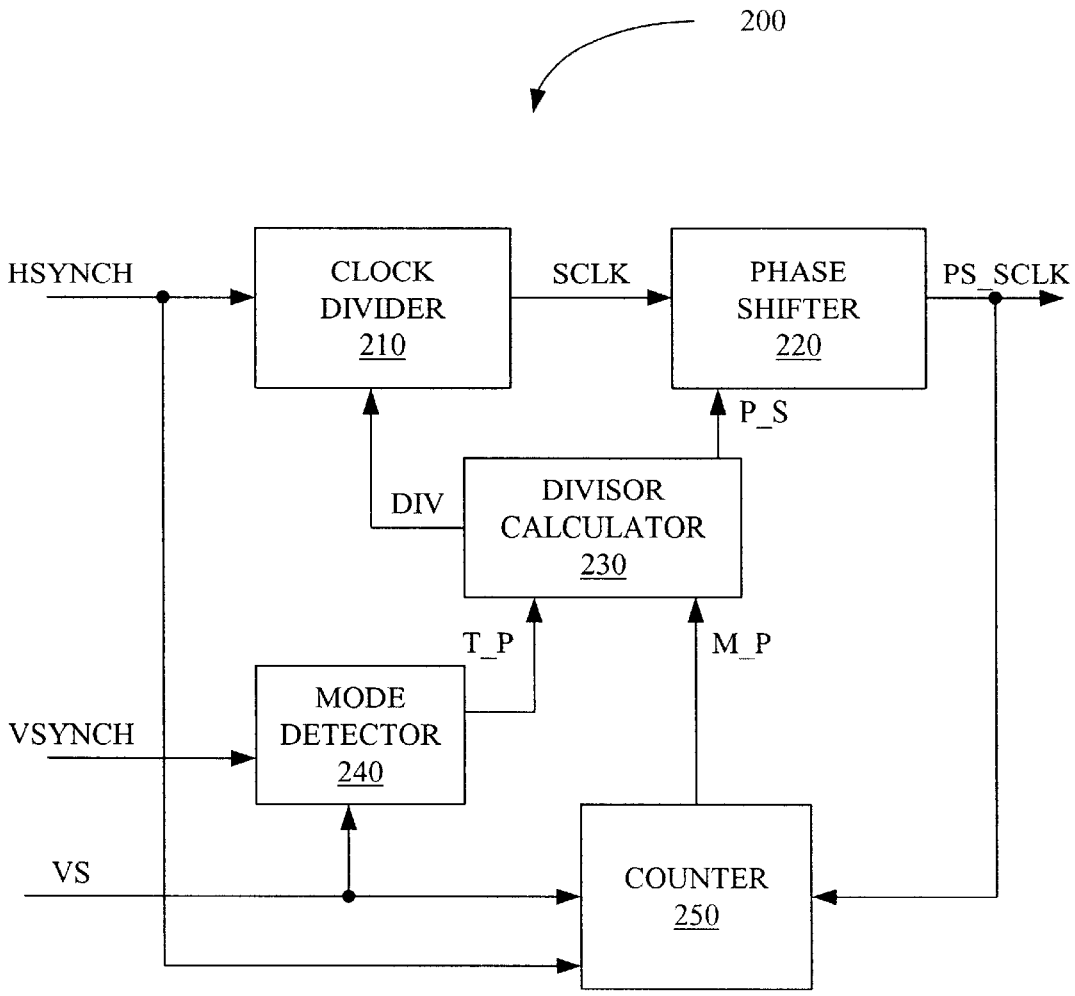
FIG. 2(*a*) is block diagram of a clock generation circuit in accordance with one embodiment of the present invention.
Figure 2B:
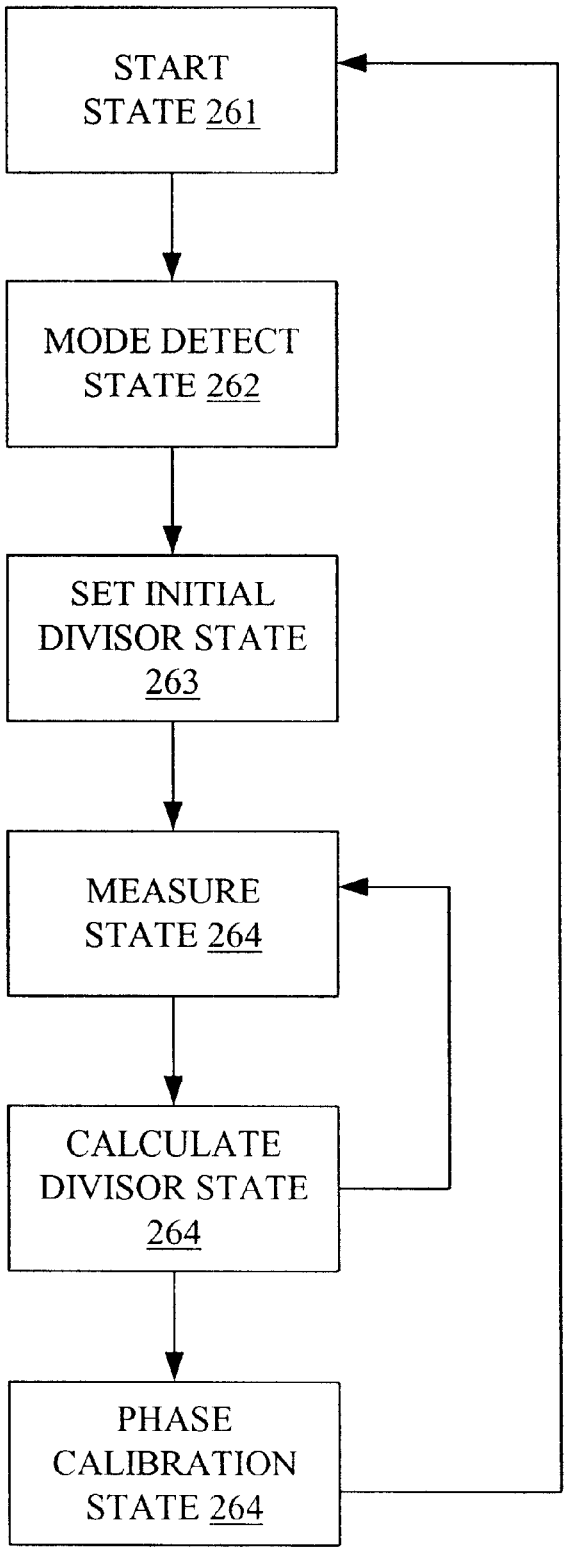

FIG. 2(*a*) is a block diagram of a clock generation circuit 200 in accordance with one embodiment of the present invention. Clock generation circuit 200 comprises a clock divider 210, a phase shifter 220, a divisor calculator 230, a mode detector 240, and a counter 250. Clock generation circuit 200 is configured to generate a sampling clock signal SCLK from horizontal synchronization signal HSYNCH and video signal VS. Specifically, sampling clock signal SCLK is tuned to have a frequency such that the number of periods of sampling clock signal SCLK during each data portion of video signal VS (i.e., between the back porch of a first horizontal blanking pulse and the front porch of a second horizontal blanking pulse) is equal to the number of pixels that are sampled on each scanline. For example, if video signal VS has a resolution of 640×480, sampling clock signal SCLK is tuned to have 640 periods during each data portion of video signal VS. Usually, the periods of sampling clock signal SCLK begin at the rising edges of sampling clock signal SCLK. Thus, for a resolution of 640×480, sampling clock signal SCLK would contain 640 rising edges during each data portion of video signal VS.

FIG. 2(*b*) provides a flow chart for clock generation circuit 200. The basic function of clock generation circuit 200 is to generate phase shifted sampling clock signal PS_SCLK with the proper frequency and optimal phase. To do so, divisor circuit 230 must calculate divisor DIV and phase shifter 220 must determine the optimal phase of phase shifted sampling clock signal PS_SCLK.

Clock generation circuit 200 is initialized to a start state 261 at power up. Clock generation circuit 200 transitions from state 261 to mode detect state 262 after power up, on reset, or when the resolution of video signal VS changes. In mode detect state 262, mode detector 240 determines the resolution of video signal VS and determines the target number of pixels in a data portion of video signal VS (hereinafter, target pixel value T_P). Target pixel value T_P is provided to divisor calculator 230. After receiving target pixel value T_P, clock generation circuit 200 transitions to set initial divisor state 263. Divisor calculator 230 sets divisor DIV to an initial value equal to an initial divisor DIVO. Then, clock generation circuit 200 transitions to measure state 264, where counter 250 measures the actual number of pixels sampled during a data portion of video signal VS (hereinafter, measured pixel value M_P) for divisor calculator 230. After receiving measured pixel value M_P, divisor calculator 230 calculates a new value for divisor DIV in calculate divisor state 264. Specifically, divisor calculator 230 tries to set divisor DIV so that the frequency of phase shifted sampling clock PS_SCLK causes measured pixel value M_P to equal target pixel value T_P. Depending on the specific embodiment of clock generation circuit 200, clock generation circuit 200 may loop between measure state 264 and calculate divisor state 264 for a number of iterations. When measured pixel value M_P equals target pixel value T_P, clock generation circuit 200 transitions to phase calibration state 264. In phase calibration state 264, phase shifter 220 selects an optimal phase for phase shifted clock signal PS_SCLK, as described below.

Once the phase of phase shifted clock signal PS_SCLK is set, clock generation circuit 200 returns to start state 261.

As explained above, the target number of pixels (i.e. target pixel value T_P) in a row of a computer image can be determined by the vertical resolution of each frame of the computer image. Thus, mode detector 240 counts the number of rows in one frame of video signal VS. In one embodiment, mode detector 240 counts the number of horizontal synch marks between two vertical synch marks to determine the number of rows in each frame of video signal VS. Mode detector 240 converts the number of rows into the target pixel value T_P, i.e. the number of pixels in a row, and provides target pixel value T_P to divisor calculator 230. In one embodiment, mode detector 240 converts the number of rows in a frame to the target number of pixels using a look up table such as TABLE 1. Specifically, mode detector 240 counts the number of rows in video signal VS and determines the polarity of horizontal synch signal HSYNCH and vertical synch signal VSYNCH. Mode detector 240 then attempts to match the characteristics of the video signal to an entry in Table 1 to determine the target pixel value. If the video signal does not match any entries in table 1, match detector 240 uses a default value, such as 1024 for target pixel value T_P. In Table 1, horizontal synch signal HSYNCH and vertical synch signal VSYNCH can have positive or negative polarities.

TABLE 1

| HSYNCH Polarity | VSYNCH Polarity | Number of Rows | Number of Pixels in a Row |
|---|---|---|---|
| P | N | 350 | 640 |
| N | P | 400 | 720 |
| N | N | 480 | 640 |
| P | P | 600 | 800 |
| Mixed | Mixed | 768 | 1024 |
| P | P | 864 | 1152 |
| P | P | 1024 | 1280 |
| P | P | 1200 | 1600 |

A conventional clock divider 210 generates sampling clock SCLK based on horizontal synchronization signal HSYNCH and a divisor DIV from divisor calculator 230. Divisor DIV is typically an integer value. Specifically, clock divider 210 generates sampling clock signal SCLK to have divisor DIV periods between the falling edges of two sequential horizontal synch marks of horizontal synchronization signal HSYNCH. Typically, clock divider 210 is implemented using a phase lock loop.

As explained above, each data portion of video signal VS lies between two horizontal blanking pulses. The horizontal blanking pulses are wider than the horizontal synch marks. Therefore, each data portion of video signal VS is less than the interval between horizontal synch marks. Consequently divisor DIV is larger than target pixel value T_P. A phase shifter 220 phase shifts sampling clock SCLK to generate phase shifted sampling clock PS_SCLK based on phase shift signal P_S from divisor calculator 230, which is described below.

Divisor calculator 230 calculates divisor DIV based on target pixel value T_P and a measured pixel value M_P provided by counter 250. As explained above, measured pixel value M_P is equal to the number of pixels which would be sampled using phase shifted sampling clock PS_SCLK. In one embodiment of counter 250 measured pixel value M_P is equal to the number of rising edges of phase shifted sampling clock signal PS_SCLK in a data portion of video signal VS.

Divisor calculator 230 sets divisor DIV equal to an initial divisor DIV0. Initial divisor DIV0 can be chosen arbitrarily but should be near target pixel value T_P. In one embodiment, initial divisor DIV0 is set equal to the power of two closest to target pixel value T_P. For example, if target pixel value T_P is equal to 640, initial divisor DIV0 is set equal to 512. Using a power of two allows multiplication to be implemented using shifters rather than a multiplier. After counter 250 measures measured pixel value M_P, divisor calculator 230 calculates divisor DIV using equation (1).

$$DIV=(DIV0*T_P)/M_P \quad (1)$$

For example if target pixel value T_P is equal to 640, initial divisor DIV0 is equal to 512, measured pixel value M_P is equal to 500, divisor DIV should equal 655. In some embodiments, a recursive subtraction circuit is used to implement division.

In some embodiments of divisor calculator 230, a recursive process is used to calculate divisor DIV. For example, some embodiment of divisor calculator 230 calculates a new divisor DIV_N from the current divisor DIV_C for every scanline until measured pixel value M_P equals target pixel value T_P. Specifically, in one embodiment, new divisor DIV_N is calculated using equation (1).

$$DIV_N=DIV_C+T_P-M_P \quad (2)$$

Figure 3:
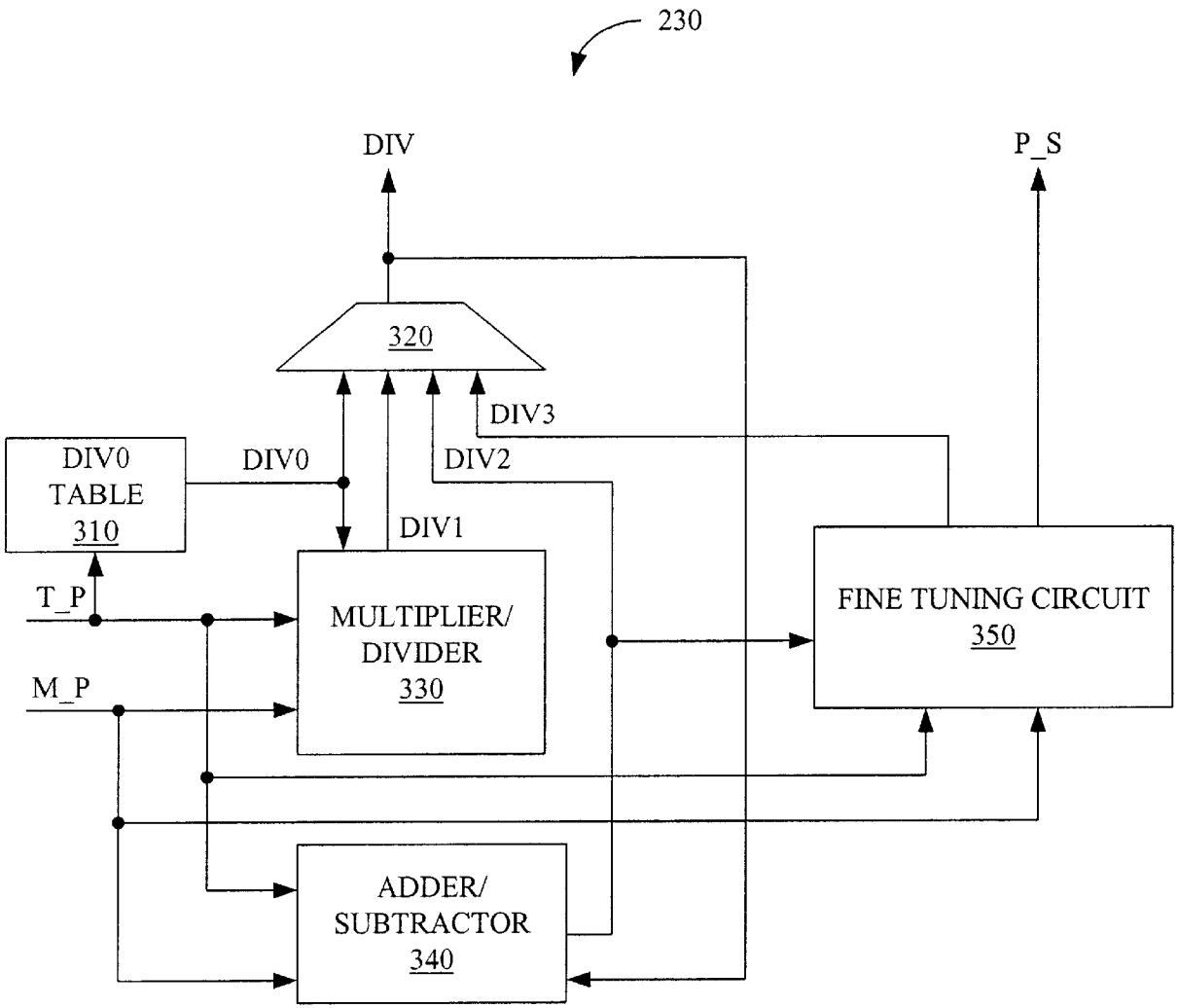
FIG. 3 is schematic diagram of a divisor calculator in accordance with one embodiment of the present invention.

FIG. 3 is a schematic diagram for an embodiment of divisor calculator 230, which uses equation (1) for rapid approximation of divisor DIV and equation (2) for precisely determining divisor DIV. Specifically, the embodiment of FIG. 3 comprises a multiplexer 320, a DIV0 table 310, a multiplier/divider 330, an adder/subtractor 340, and a fine tuning circuit 350. DIV0 table 310 transmits an initial divisor DIV0, which is based on target pixel value T_P, to a first input terminal of multiplexer 320. Initially, multiplexer 320 is configured to output initial divisor DIV0 from DIV0 table 310. After counter 250 (FIG. 2(*a*)) measures measured pixel value M_P, multiplier/divider 330 calculates a divisor DIV1 which is equal to (DIV0*T_P)/M_P. Divisor DIV1 is transmitted to multiplexer 320, which is reconfigured to transmit divisor DIV1 as divisor DIV. Adder/subtractor 340 calculates divisor DIV2, which is equal to DIV+T_P−M_P, and transmits divisor DIV2 to a third input of multiplexer 320, which is reconfigured to transmit divisor DIV2 as divisor DIV.

Some embodiments of divisor calculator 230 also includes fine tuning circuit 350. Fine tuning circuit 350 compensates for possible rounding errors in divisor DIV2 caused by the phase of sampling clock signal SCLK. For example, although divisor DIV2 causes target pixel value T_P to equal measured pixel value M_P, divisor DIV2 may not be the optimal value for all phases of sampling clock signal SCLK. Therefore, fine tuning circuit 350 calculates divisor DIV3; which is equal to divisor DIV2, divisor DIV2 plus one, or divisor DIV2 minus 1; by comparing multiple phases of sampling clock signal SCLK for each possible value of DIV3.

Figure 4:
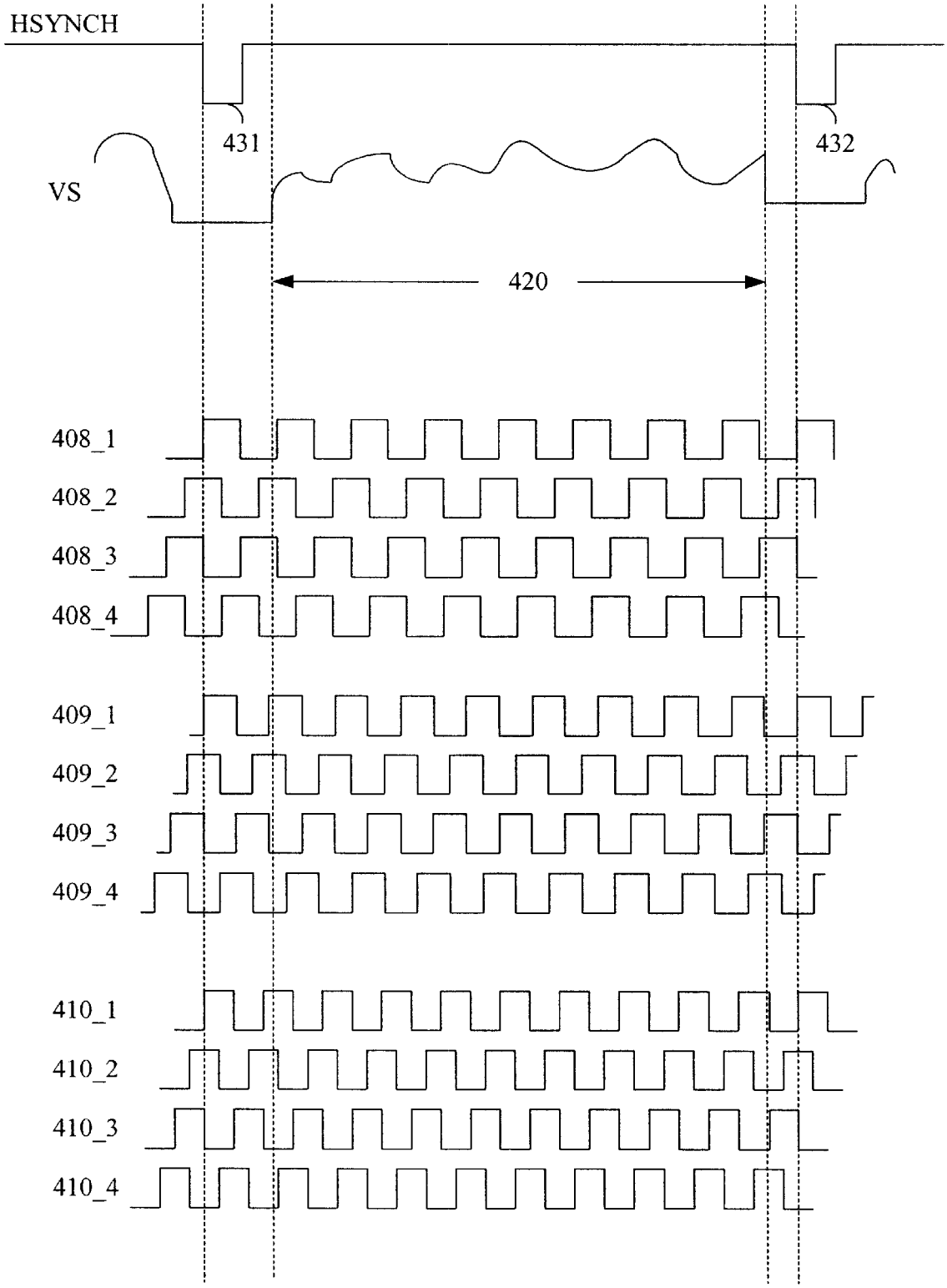
FIG. 4 is an illustrative example for a fine tuning controller in accordance with one embodiment of the present invention.

FIG. 4 shows an example illustrating the benefits and functionality of one embodiment of fine tuning circuit 350. For the example of FIG. 4, divisor DIV2 is assigned the integer value nine. Therefore, fine tuning circuit compares various phases of sampling clock signal SCLK with DIV3 assigned the integer values eight, nine, and ten. FIG. 4 shows 12 possible sampling clock signals 408_1–408_4, 409_1–409_4, and 410_1–410_4, which are used to sample a data portion 420 of video signal VS located between horizontal synch marks 431 and 432 of horizontal synchronization signal HSYNCH. Each sampling clock signal X_Y is phase shifted by 90 degrees (i.e. 0.25 clock periods) from sampling clock signal X_Y−1. For example, sampling clock signal 409_2 is phase shifted by 90 degrees from sampling clock signal 409_1.

Sampling clock signals 408_1–408_4 are initially generated with divisor DIV3 equal to eight. Therefore, sampling clock signals 408_1–408_4 have eight clock periods between the rising edge of horizontal synch mark 431 and the rising edge of horizontal synch mark 432. Then, divisor DIV3 is assigned the value nine to generate sampling clock signals 409_1–409_4, which have nine clock periods between the rising edge of horizontal synch mark 431 and the rising edge of horizontal synch mark 432. Then, divisor DIV3 is assigned the value 10 to generate sampling clock signals 410_1–410_4, which have ten clock periods between the rising edge of horizontal synch mark 431 and the rising edge of horizontal synch mark 432.

TABLE 2 provides a listing of measured pixel value M_P for sampling clock signals 408_1–408_4, 409_1–409_4, and 410_1–410_4. As explained above, measured pixel value M_P for a sampling clock signal is equal to the number of rising edges of the sampling clock signal between two successive horizontal blanking pulses of video signal VS.

TABLE 2

| SAMPLING CLOCK SIGNAL | Measured Pixel value |
|---|---|
| 408_1 | 7 |
| 408_2 | 6 |
| 408_3 | 7 |
| 408_4 | 7 |
| 409_1 | 7 |
| 409_2 | 7 |
| 409_3 | 8 |
| 409_4 | 8 |
| 410_1 | 8 |
| 410_2 | 8 |
| 410_3 | 8 |
| 410_4 | 9 |

Assuming target pixel value T_P is equal to seven, adder/subtractor 340 (FIG. 3) may calculate divisor DIV2 to be equal to nine because both sampling clock signal 409_1 and sampling clock signal 409_2 cause measured pixel value M_P to be equal to target pixel value T_P. However, sampling clock signal 409_3 and sampling clock signal 409_4 cause measured pixel value M_P to not equal target pixel value T_P. In comparison, sampling clock signal 408_1, 408_3, and 408_4 cause measured pixel value M_P to be equal to target pixel value T_P. Thus, divisor DIV3 should be equal to eight rather than nine.

Similarly, if target pixel value T_P is equal to eight, adder/subtractor 340 (FIG. 3) may calculate divisor DIV2 to be equal to nine because both sampling clock signal 409_3 and sampling clock signal 409_4 cause measured pixel value M_P to be equal to target pixel value T_P. However, sampling clock signal 409_1 and sampling clock signal 409_2 cause measured pixel value M_P to not equal target pixel value T_P. In comparison, sampling clock signal 410_1, 410_2, and 410_3 cause measured pixel value M_P to be equal to target pixel value T_P. Thus, divisor DIV3 should be equal to ten rather than nine.

Figure 5:
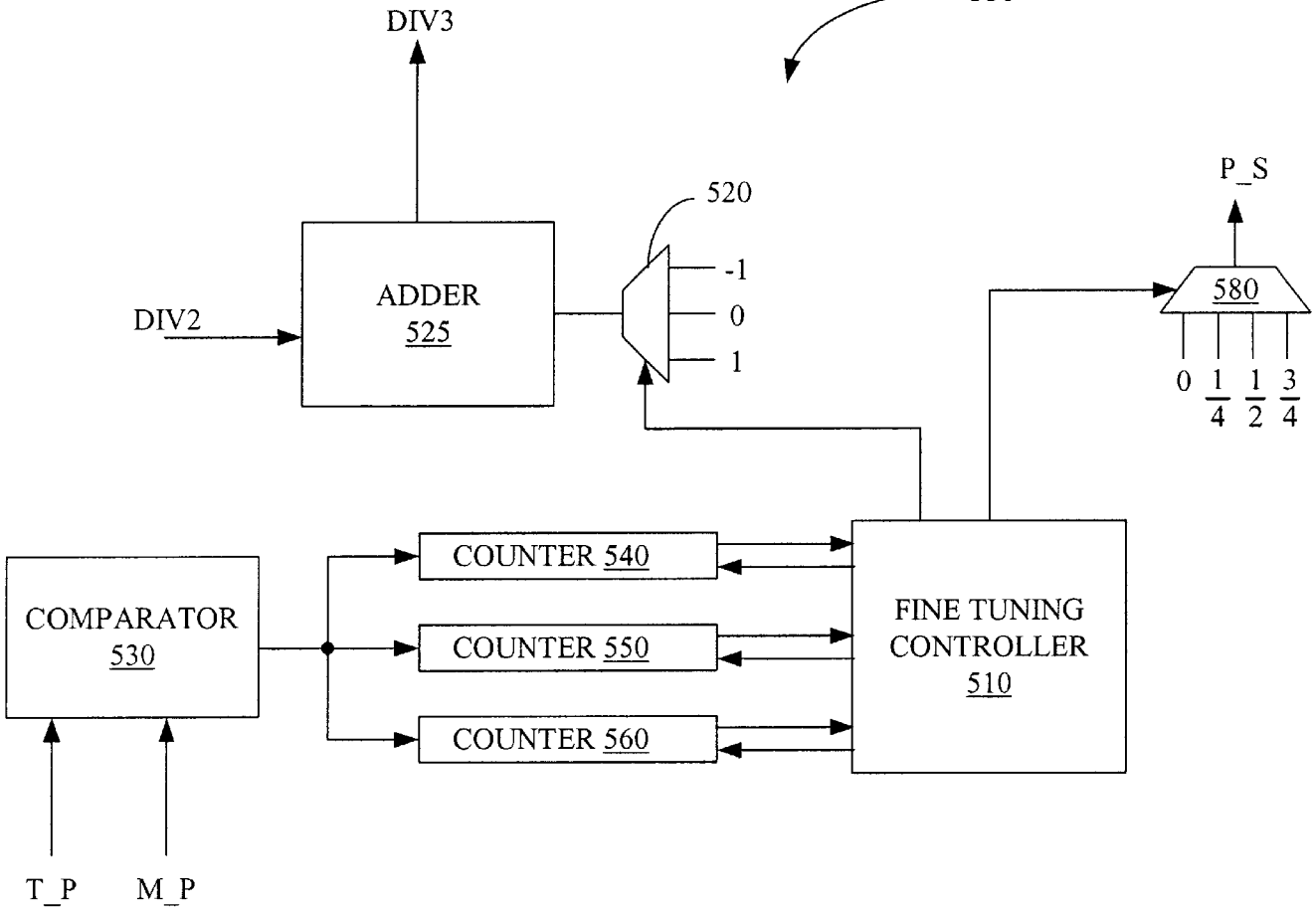
FIG. 5 is a schematic diagram of a fine tuning circuit in accordance with one embodiment of the present invention.

FIG. 5 is a schematic diagram showing one embodiment of fine tuning circuit 350. The embodiment of FIG. 5 comprises a fine tuning controller 510, an adder 525, a multiplexer 520, a multiplexer 580, a comparator 530, and counters 540, 550, and 560. Adder 525 adds divisor DIV2 to the output signal from multiplexer 520 to generate divisor DIV3. Multiplexer 520 selects between three input values (negative one, zero, and positive one) under the control of fine tuning controller 510. Fine tuning controller 510 also controls multiplexer 580 which transmits a phase shift signal P_S to phase shifter 220 (FIG. 2(*a*)). In the embodiment of FIG. 5, multiplexer 580 selects between four inputs (0, ¼, ½, and ¾), which cause phase shifter 220 (FIG. 2(*a*)) to shift sampling clock signal SCLK by 0, ¼, ½, or ¾ of a clock period, respectively. Phase shifter 220 generates phase shifted sampling clock signal PS_SCLK which is used to sample video signal VS.

Comparator 530 compares target pixel value T_P with measured pixel value M_P. If target pixel value T_P is equal to measured pixel value M_P, comparator 530 generates an increment signal to counters 540, 550, and 560. Counters 540, 550, and 560 are used to count the number of phases of phase shifted clock signal PS_SCLK in which target pixel value T_P is equal to measured pixel value M_P, for the three possible values of divisor DIV3. Therefore, when multiplexer 520 is configured to select negative 1, fine tuning controller 510 only enables counter 540. When multiplexer 520 is configured to select zero, fine tuning controller 510 only enables counter 550. Similarly, when multiplexer 520 is configured to select positive 1, fine tuning controller 510 only enables counter 560.

After all twelve possible sampling clock signals 408_1–408_4, 409_1–409_4, and 410_1–410_4 are tested, fine tuning controller 510 compares the values of counters 540, 550, and 560. If counter 540 contains the greatest value, fine tuning controller 510 configures multiplexer 520 to select negative 1, i.e. divisor DIV3 is set equal to divisor DIV2 minus 1. If counter 550 contains the greatest value or is tied for the greatest value, fine tuning controller 510 configures multiplexer 520 to select zero, i.e. divisor DIV3 is set equal to divisor DIV2. If counter 560 contains the greatest value, fine tuning controller 510 configures multiplexer 520 to select negative 1, i.e. divisor DIV3 is set equal to divisor DIV2 plus 1.

The functionality of fine tuning controller 510 is described by the pseudo code of TABLE 3. Fine tuning controller 510 can be implemented by converting the pseudo code of TABLE 3 into a hardware definition language, such as Verilog.

TABLE 3

```
START:
DIV3=DIV2−1:

Configure MUX 520 to select negative 1
Enable Counter 540.
Disable Counters 550 and 560
Configure MUX 580 to select 0
Sample one data portion of video signal VS.
Configure MUX 580 to select 1/4
Sample one data portion of video signal VS.
Configure MUX 580 to select 1/2
Sample one data portion of video signal VS.
Configure MUX 580 to select 3/4
Sample one data portion of video signal VS.
DIV3=DIV2:

Configure MUX 520 to select 0
Enable Counter 550
Disable Counters 540 and 560
Configure MUX 580 to select 0
Sample one data portion of video signal VS.
```

TABLE 3-continued

| |
|---|
| Configure MUX 580 to select 1/4 |
| Sample one data portion of video signal VS. |
| Configure MUX 580 to select 1/2 |
| Sample one data portion of video signal VS. |
| Configure MUX 580 to select 3/4 |
| Sample one data portion of video signal VS. |
| DIV3=DIV2+1: |
| Configure MUX 520 to select positive 1 |
| Enable Counter 560 |
| Disable Counters 550 and 560 |
| Configure MUX 580 to select 0 |
| Sample one data portion of video signal VS. |
| Configure MUX 580 to select 1/4 |
| Sample one data portion of video signal VS. |
| Configure MUX 580 to select 1/2 |
| Sample one data portion of video signal VS. |
| Configure MUX 580 to select 3/4 |
| Sample one data portion of video signal VS. |
| COMPARE: |
| IF (Counter 540>Counter 550) and (Counter 540>Counter 560) then configure MUX 520 to select negative 1, END. |
| IF (Counter 550>=Counter 540) and (Counter 550>=Counter 560) then configure MUX 520 to select zero, END. |
| IF (Counter 560>Counter 550) and (Counter 560>Counter 540) then configure MUX 520 to select negative 1, END. |

Some embodiments of clock generation circuit also calibrates the phase of phase shifted sampling clock signal PS_SCLK. In these embodiments phase shifter 220 is able to phase shift sampling clock signal SCLK by more precise amounts than the quarter period steps used by fine tuning circuit 350. The goal of the phase calibration is to improve the output image quality from a digitizer using clock generation circuit 200. The determination of image quality can vary. In one embodiment, image quality is proportional to the sum of the size of the horizontal edges in the image.

Figure 6:
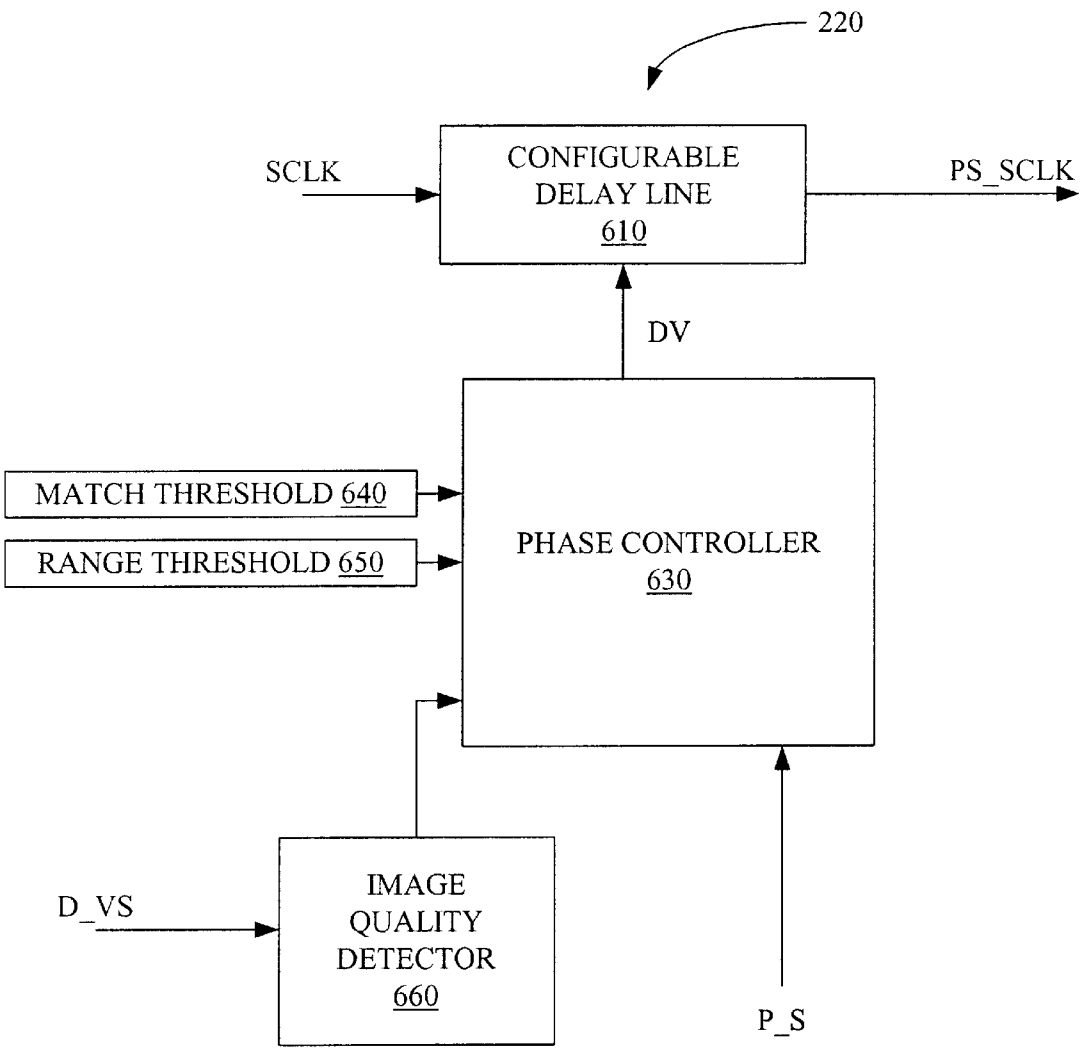
FIG. 6 is a schematic diagram of phase shifter in accordance with a second embodiment of the present invention.
Figure 7A:
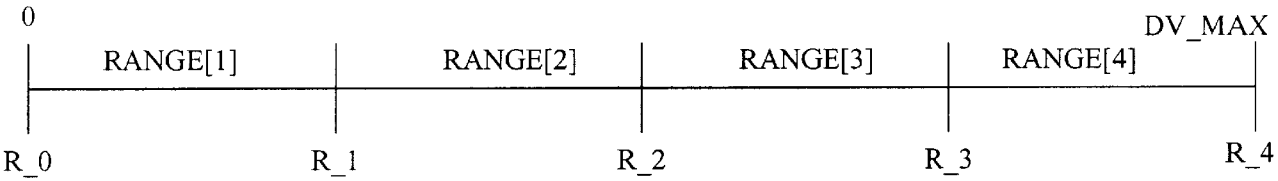
FIG. 7 is a illustrative example for a phase controller in accordance with one embodiment of the present invention.
Figure 7B:
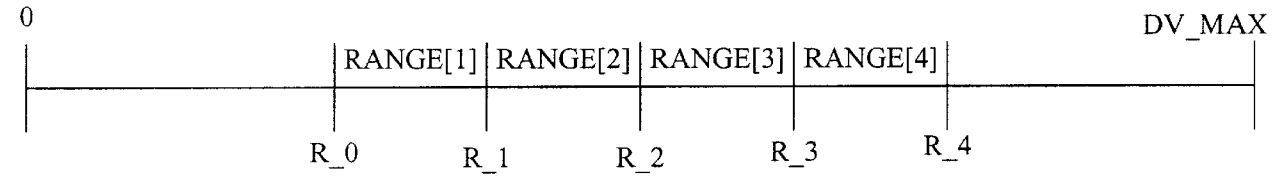
Figure 7C:
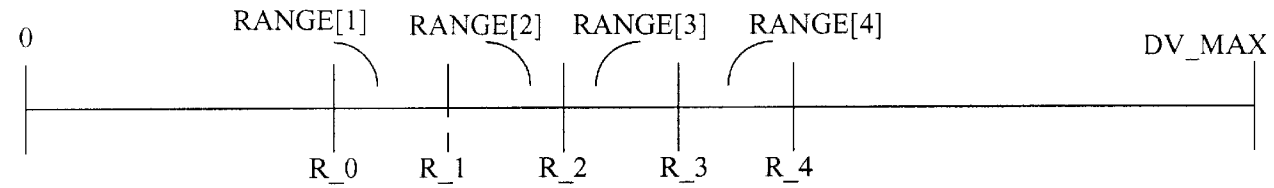
Figure 7D:
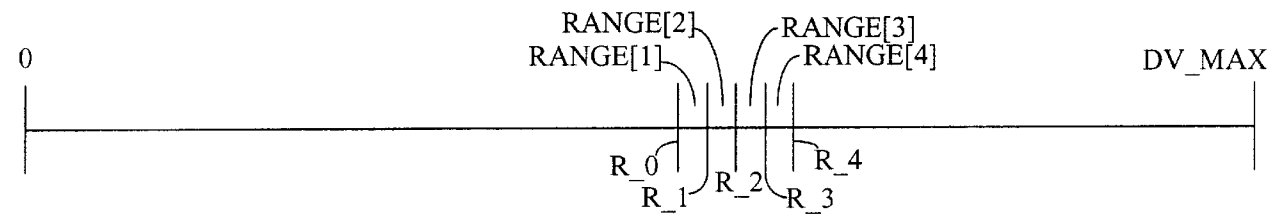

FIG. 6 is a block diagram of an embodiment of phase shifter 220 which performs phase calibration. The embodiment of FIG. 6 includes a configurable delay line 610, a phase controller 630, a match threshold register 640, a range threshold register 650, and an image quality detector 660. Configurable delay line 610 phase shifts sampling clock signal SCLK to generate phase shifted sampling clock signal PS_SCLK under the control of phase controller 630. Configurable delay line 610 provides delay times equal to a multiple of a delay unit DU. The length of delay unit DU is provided to phase controller 630. Phase controller 630 transmits a delay value DV to configurable delay line 610, which causes configurable delay line 610 to provide a delay of DV*DU (i.e. delay value DV times delay unit DU).

In some embodiments, configurable delay line 610 is controlled by phase controller 630 using pulse width modulation. For these embodiment, phase controller 630 converts delay value DV into a single delay control signal. The delay generated by configurable delay line 610 is proportional to the duty cycle of the delay control line. Specifically, in one embodiment, configurable delay line 610 can provide a delay of 0 to 511 times delay unit DU. To generate a delay of X delay units, phase controller 630 generates the delay control signal that has high pulses of length X delay units followed by low pulses of length 511-X delay units. In other embodiments, phase controller 630 sends delay value DV as a multi-bit binary number to configurable delay line 610.

Phase controller 630 functions in two different modes: standby mode and calibration mode. In standby mode, phase controller 630 configures configurable delay line 610 to provide delays equal to 0, ¼, ½, or ¾ of the clock period of sampling clock signal SCLK as dictated by phase shift signal P_S from multiplexer 580 (FIG. 5).

After fine tuning controller 510 (FIG. 5) selects divisor DIV3, phase controller 630 enters phase calibration mode. In phase calibration mode, phase controller 630 tries to find a specific value for delay value DV (i.e., DV_BEST) that provides the highest quality index QI for the digital images sampled by the digitizer using clock generation circuit 200. Quality index QI is calculated by image quality detector 660, which analyzes a digital video signal D_VS generated by the digitizer using clock sampling circuit 200. Delay value DV should have a value between 0 and DV_MAX, where DV_MAX is equal to the smallest number that, when multiplied by delay unit DU, is greater than or equal to the period of sampling clock signal SCLK.

In one embodiment, phase controller 630 finds delay value DV_BEST by testing every possible value of delay value DV between 0 and DV_MAX, and selecting the value that results in the highest quality index QI as delay value DV_BEST. However, if DV_MAX is large, for example 511 as in one embodiment of the present invention, finding delay value DV_BEST in this manner would require testing 511 frames, which would require approximately 6–8 seconds, which may be unacceptable.

Consequently, some embodiments of the present invention finds a delay value DV_GOOD which provides a high quality index QI but perhaps not the highest quality index QI. In a specific embodiment, phase controller 630 creates N equally sized ranges between 0 and DV_MAX. For clarity the ranges are called RANGE[X], where X is an integer from 1 to N. Dividing points between the ranges are indicated by R_Y, where Y is an integer from 0 to N. Therefore, range RANGE[X] lies between R_(X−1) and R_X, where X is an integer from 1 to N. R_0 is set initially to equal zero, and R_N is set initially to equal DV_MAX. R_Z, where Z is an integer from 1 to N−1 is defined by equation (3).

$$R_Z=R_(Z-1)+(R_N-R_0)/N \tag{3}$$

Phase controller 630 sequentially sets delay value DV to equal the midpoint of each RANGE[X] and receives a quality index QI[X], where X is an integer from 1 to N, from image quality detector 660. Phase controller 630 then redefines R_0 and R_N based on the quality indices QI[1] to QI[N]. In one embodiment, only the range with the highest quality index is retained. Assuming RANGE[BEST], where BEST is an integer, has the highest quality index, R_0 is equated to R_(BEST−1) and R_N is equated to R_BEST. Phase controller 630 then redefines N new ranges between the new R_0 and the new R_N. This process continues until R_N−R_0 is less than a range threshold value R_Thresh from range threshold register 640.

In another embodiment of the present invention, match threshold register 640 contains a match threshold value M_T, which is an integer from 0 to 100 representing a percentage. Adjacent ranges next to RANGE[BEST] are also retained if the quality index of the adjacent range is within match threshold value M_T of the quality index of RANGE[BEST]. In another embodiment of phase controller 630, the ranges adjacent to RANGE[BEST] as well as the ranges adjacent to the next adjacent ranges, are kept if the quality indices of the next adjacent ranges are within match threshold value M_T of the quality index of RANGE [BEST]. In cases where all of the ranges should be retained due to several quality indices being within match threshold value M_T of the best quality index QI[BEST], only RANGE[BEST], the best range, or RANGE[BEST], RANGE[BEST−1] and RANGE[BEST+1], i.e. the best range and the two adjacent ranges, are retained.

FIGS. 7(*a*)–7(*d*) illustrate an example with N equal 4, DV_MAX equal to 511, R_Thresh equal to 20, and M_T equal to 20%. FIG. 7(*a*) shows the possible values for delay value DV. Specifically, delay value DV can be between 0 and DV_MAX, inclusive. Phase controller 630 divides the possible values of delay value DV into four ranges, RANGE[1]–RANGE[4], which are separated at dividing points R_1, R_2, and R_3. TABLE 4(*a*) provides the values for quality indices QI[X] and the values for R_X and R_X−1 and for each RANGE[X] in FIG. 7(*a*).

TABLE 4(a)

| | | | |
|---|---|---|---|
| RANGE[1]: | R_0 = 0 | R_1 = 127 | QI[1] = 67 |
| RANGE[2]: | R_1 = 127 | R_2 = 255 | QI[2] = 112 |
| RANGE[3]: | R_2 = 255 | R_3 = 382 | QI[3] = 124 |
| RANGE[4]: | R_3 = 382 | R_4 = 511 | QI[4] = 45 |

Since quality index QI[3] is the greatest quality index, RANGE[3] is retained. Furthermore, since QI[2] is within 20% of quality index QI[3], RANGE[2] is also retained. Therefore, R_0 is set equal to R_1 (i.e. 127) and R_4 is set equal to R_3 (i.e. 382). Since R_4−R_0 is greater than R_Thresh, phase controller 610 redefines the four ranges and measures the quality index at the midpoint of each range. FIG. 7(*b*) illustrates the new ranges. TABLE 4(*b*) provides the actual values for the ranges illustrated in FIG. 7(*b*).

TABLE 4(b)

| | | | |
|---|---|---|---|
| RANGE[1]: | R_0 = 127 | R_1 = 191 | QI[1] = 123 |
| RANGE[2]: | R_1 = 191 | R_2 = 255 | QI[2] = 86 |
| RANGE[3]: | R_2 = 255 | R_3 = 319 | QI[3] = 133 |
| RANGE[4]: | R_3 = 319 | R_4 = 382 | QI[4] = 45 |

Since quality index QI[3] is the greatest quality index, RANGE[3] is retained. Furthermore, since QI[1] is within 20% of quality index QI[3], RANGE[1] is also retained. In addition, because RANGE[2] lies between RANGE[1] and RANGE[3], RANGE[2] is also retained. Therefore, R_0 remains at 127, and R_4 is set equal to R_3 (i.e. 319). Since R_4 −R_0 is greater than R_Thresh, phase controller 610 redefines the four ranges and measures the quality index at the midpoint of each range. FIG. 7(*c*) illustrates the new ranges. TABLE 4(*c*) provides the actual values for the ranges illustrated in FIG. 7(*c*).

TABLE 4(c)

| | | | |
|---|---|---|---|
| RANGE[1]: | R_0 = 127 | R_1 = 175 | QI[1] = 56 |
| RANGE[2]: | R_1 = 175 | R_2 = 223 | QI[2] = 76 |
| RANGE[3]: | R_2 = 223 | R_3 = 271 | QI[3] = 102 |
| RANGE[4]: | R_3 = 271 | R_4 = 319 | QI[4] = 145 |

Since quality index QI[4] is the greatest quality index, RANGE[4] is retained. Furthermore, since quality indices QI[1], QI[2], and QI[3] are not within 20% of quality index QI[4], only RANGE[4] is retained. Therefore, R_0 is set equal to R_3 (i.e. 271), and R_4 remains at 319. Since R_4−R_0 is greater than R_Thresh, phase controller 610 redefines the four ranges and measures the quality index at the midpoint of each range. FIG. 7(*d*) illustrates the new ranges. TABLE 4(*d*) provides the actual values for the ranges illustrated in FIG. 7(*d*).

TABLE 4(c)

| | | | |
|---|---|---|---|
| RANGE[1]: | R_0 = 271 | R_1 = 283 | QI[1] = 56 |
| RANGE[2]: | R_1 = 283 | R_2 = 295 | QI[2] = 76 |
| RANGE[3]: | R_2 = 295 | R_3 = 307 | QI[3] = 102 |
| RANGE[4]: | R_3 = 307 | R_4 = 319 | QI[4] = 155 |

Since quality index QI[4] is the greatest quality index, RANGE[4] is retained. Furthermore, since quality indices QI[1], QI[2], and QI[3] are not within 20% of quality index QI[4], only RANGE[4] is retained. Therefore, R_0 is set equal to R_3 (i.e. 301), and R_4 remains at 319. Since R_4−R_0 is less than R_Thresh, phase controller 610 defines delay value DV_GOOD to be equal to R_0+(R_4−R_0)/2 which equals 310. Phase controller then transmits delay value DV_GOOD to configurable delay line 610.

TABLE 5 provides pseudo code, which can be converted into a hardware definition language such as Verilog, for the embodiment of phase controller 630 used in example of FIG. 7(*a*)–7(*d*).

TABLE 5

```
STANDBY MODE:
    DV = DV_MAX * P_S.
PHASE CALIBRATION MODE:
    R_4 = DV_MAX
    R_0 = 0
    While ((R_4 − R_0) > R_Thresh) {
        R_1 = R_0 + (R_4 − R_0)/4
        R_2 = R_1 + (R_4 − R_0)/4
        R_3 = R_2 + (R_4 − R_0)/4
        DV = (R1 − R0)/2
        MEASURE QI[1]
        DV = (R2 − R1)/2
        MEASURE QI[2]
        DV = (R3 − R2)/2
        MEASURE QI[3]
        DV = (R4 − R3)/2
        MEASURE QI[4]
        BEST = 4
        IF (QI[3] >= QI[BEST]) THEN BEST = 3
        IF (QI[2] >= QI[BEST]) THEN BEST = 2
        IF (QI[1] >= QI[BEST]) THEN BEST = 1
        LR=BEST−1; "LR is the lowest R to retain"
        IF (BEST−1 >0) {
            IF QI[BEST−1] >= QI[BEST]*M_T/100 THEN
            LR=BEST−2
            }
        IF (BEST−2 > 0) {
            IF QI[BEST−2] >= QI[BEST]*M_T/100 THEN
            LR=BEST−3
            }
        HR=BEST; "HR is the highest R to retain"
        IF (BEST+1 <= 4) {
            IF QI[BEST+1] >= QI[BEST]*M_T/100 THEN
            HR=BEST+1
            }
        IF (BEST+2 <= 4 {
            IF QI[BEST+2] >= QI[BEST]*M_T/100 THEN
            HR=BEST+2
            }
        R_4=R_HR
        R_0=R_LR
        }
    DV_GOOD = R_0 + (R_4 − R_0)/2
    DV=DV_GOOD
END
```

In the various embodiments of this invention, methods and structures have been described for generating a phase shifted sampling clock to be used in digitizing an analog video signal. The frequency of the phase shifted sampling clock signal is calculated by a divisor calculator that calculates the divisor used by a clock divider circuit to generate the phase shifted sampling clock signal. The divisor is refined by a fine tuning circuit to provide the best possible divisor value. To further enhance image quality, a phase controller selects the phase of the phase shifted sampling clock to maximize an image quality index to provide sharper images on a digital display.

The various embodiments of the structures and methods of this invention that are described above are illustrative only of the principles of this invention and are not intended to limit the scope of the invention to the particular embodiments described. For example, in view of this disclosure, those skilled in the art can define other clock dividers, divisor calculators, phase shifters, mode detectors, counters, phase controllers, fine tuning controllers, video modes, and so forth, and use these alternative features to create a method, circuit, or system according to the principles of this invention. Thus, the invention is limited only by the following claims.

What is claimed is:

1. A method for generating a sampling clock signal for sampling a video signal, said method comprising the steps of:

generating said sampling clock signal using an initial divisor;

measuring a first measured pixel value equal to a number of periods of said sampling clock signal in a data portion of said video signal;

calculating a first divisor, wherein said first divisor is calculated to cause a second measured pixel value measured using said sampling clock generated using said first divisor to equal a target pixel value; and regenerating said sampling clock signal with said first divisor.

2. The method of claim 1, wherein said step of calculating a first divisor comprises the steps of:

multiplying said target pixel value with said initial divisor to form a product; and dividing said product by said measured pixel value.

3. The method of claim 1, wherein said step of calculating a first divisor comprises the steps of:

recursively calculating said first divisor until said target pixel value equals said measured pixel value; and equating said divisor to said new divisor.

4. The method of claim 3, wherein said first divisor is calculated to equal a current divisor plus said target pixel value minus said measured pixel value.

5. The method of claim 1, further comprising the steps of:

calculating a second divisor; and regenerating said sampling clock signal using said second divisor.

6. The method of claim 5, wherein said step of calculating a second divisor comprises the steps of:

adding said target pixel value to said first divisor to form a sum; and subtracting said measured pixel value from said sum.

7. The method of claim 5, wherein said step of calculating said second divisor comprises the steps of:

phase shifting said sampled clock signal through a plurality of phases; and measuring said measured pixel value at each of said phases to generate a first plurality of measured pixel values.

8. The method of claim 7, further comprising the steps of:

setting said second divisor to equal said first divisor minus 1;

regenerating said sampled clock signal using said second divisor;

phase shifting said sampled clock signal through a plurality of phases; and measuring said measured pixel value at each of said phases to generate a second plurality of measured pixel values.

9. The method of claim 8, further comprising the steps of setting said second divisor to equal said first divisor plus 1;

regenerating said sampled clock signal using said second divisor;

phase shifting said sampled clock signal through a plurality of phases; and measuring said measured pixel value at each of said phases to generate a third plurality of measured pixel values.

10. The method of claim 9, further comprising the steps of:

counting a first number of matches by comparing each measured pixel value of said first plurality of measured pixel value with said target pixel value;

counting a second number of matches by comparing each measured pixel value of said second plurality of measured pixel value with said target pixel value;

counting a third number of matches by comparing each measured pixel value of said third plurality of measured pixel value with said target pixel value;

setting said second divisor equal said first divisor if said first number of matches is greater than or equal to said second number of matches and said third number of matches;

setting said second divisor equal to said first divisor minus one if said second number of matches is greater than said first number of matches and said third number of matches; and setting said second divisor equal to said first divisor plus one if said third number of matches is greater than said first number of matches and said second number of matches.

11. The method of claim 1, further comprising the steps of:

measuring a vertical resolution of an image of said video signal;

selecting a target pixel value based on said vertical resolution.

12. A clock generating circuit for generating a sampling clock signal for sampling a video signal accompanied by a horizontal synchronization signal, said circuit comprising:

a clock divider configured to receive said horizontal synchronization signal and configured to generate said sampling clock signal;

a divisor calculator coupled to said clock divider and configured to calculate a divisor for said clock divider;

a mode detector coupled to said divisor calculator and configured to calculate a target pixel value; and a counter coupled to said clock divider and configured to receive said video signal and configured to measure a measured pixel value.

13. The clock generating circuit of claim 12, wherein said divisor calculator circuit is configured to select an initial divisor and to calculate said divisor to equal said initial divisor times said target pixel value divided by said measured pixel value.

14. The clock generating circuit of claim 12, wherein said divisor calculator circuit is configured to recursively calculate said divisor by adding said target pixel value and subtracting said measured pixel value to said divisor until said target pixel value equals said measured pixel value.

15. The clock generating circuit of claim 12, wherein said divisor calculator further comprises:

a multiplier/divider coupled to said mode detector and said counter and configured to generate a first divisor;

an initial divisor lookup table coupled to said mode detector and configured to generate said initial divisor; and a first multiplexer having a first input coupled to said initial divisor lookup table, a second input coupled to said multiplier divider, and an output coupled to said clock divider.

16. The clock generating circuit of claim 15, further comprising an adder/subtractor coupled to said mode detector, said counter, and a third input of said first multiplexer, wherein said adder/subtractor is configured to generate a second divisor.

* * * * *

UNITED STATES PATENT AND TRADEMARK OFFICE

CERTIFICATE OF CORRECTION

PATENT NO. : 6,310,618 B1
DATED : October 30, 2001
INVENTOR(S) : Biao Zhang and Chin-Cheng Kau It is certified that error appears in the above-identified patent and that said Letters Patent is hereby corrected as shown below:

Title page, Item [54] and Column 1, lines 1-2,
Title, should read:

-- [54] CLOCK GENERATION FOR SAMPLING ANALOG VIDEO --

Signed and Sealed this

Fifth Day of November, 2002

*Attest:*

*Attesting Officer*

JAMES E. ROGAN
*Director of the United States Patent and Trademark Office*